US008128507B1

(12) United States Patent
Chuck

(10) Patent No.: US 8,128,507 B1
(45) Date of Patent: Mar. 6, 2012

(54) TRAINING TOOL FOR MAINTAINING PROPER HAND POSITION THROUGH A GOLF SWING AND METHOD OF USE

(76) Inventor: Martin Chuck, Bend, OR (US)

( * ) Notice: Subject to any disclaimer, the term of this patent is extended or adjusted under 35 U.S.C. 154(b) by 0 days.

(21) Appl. No.: 12/985,084

(22) Filed: Jan. 5, 2011

(51) Int. Cl.
*A63B 69/36* (2006.01)

(52) U.S. Cl. ..... 473/276; 473/227; 473/409

(58) Field of Classification Search ..... 473/212, 473/213, 219, 226, 227, 238, 266, 276, 409
See application file for complete search history.

(56) References Cited

U.S. PATENT DOCUMENTS

| | | | | |
|---|---|---|---|---|
| 3,918,721 | A | 11/1975 | Trask, Jr. | |
| 5,009,426 | A * | 4/1991 | Cox | 473/227 |
| 5,152,533 | A | 10/1992 | Radakovich | |
| 5,679,080 | A | 10/1997 | Finsterwald | |
| 5,772,523 | A | 6/1998 | Sheftic | |
| 5,904,624 | A * | 5/1999 | Martinez | 473/212 |
| 6,004,221 | A * | 12/1999 | Thornhill | 473/227 |
| 6,196,930 | B1 | 3/2001 | Aumock | |
| 6,656,056 | B1 | 12/2003 | Leonard | |
| 6,719,639 | B2 * | 4/2004 | Novosel, Sr. | 473/213 |
| D493,503 | S | 7/2004 | Rohan-Weaver | |
| 6,881,155 | B2 * | 4/2005 | Rohan-Weaver | 473/219 |
| 7,033,282 | B1 * | 4/2006 | Flood | 473/227 |
| 7,090,588 | B2 | 8/2006 | Bamber | |
| 2007/0275788 | A1 | 11/2007 | Delpine | |
| 2009/0111599 | A1 | 4/2009 | Dantas | |

* cited by examiner

*Primary Examiner* — Nini Legesse
(74) *Attorney, Agent, or Firm* — Greenberg Traurig

(57) ABSTRACT

An adjustable arching arm attaches to a top portion of a golf club such that the adjustable arching arm is generally in alignment with a club face. The adjustable arching arm is adjustable in a generally vertical plane to accommodate chip shots and full swings. In a chipping mode, the adjustable arching arm is in a lower position and is intended to maintain contact with an inside of the left forearm (of a right handed golfer) through a chip shot thereby training the golfer to hold his (or her) hands in the correct position through a chip shot. In a full swing mode, the adjustable arching arm is adjusted to an upper position such that the adjustable arching arm is able to move from inside of the left forearm to outside of the left forearm during the swing to indicate good hand position.

13 Claims, 5 Drawing Sheets

FIG. 5C
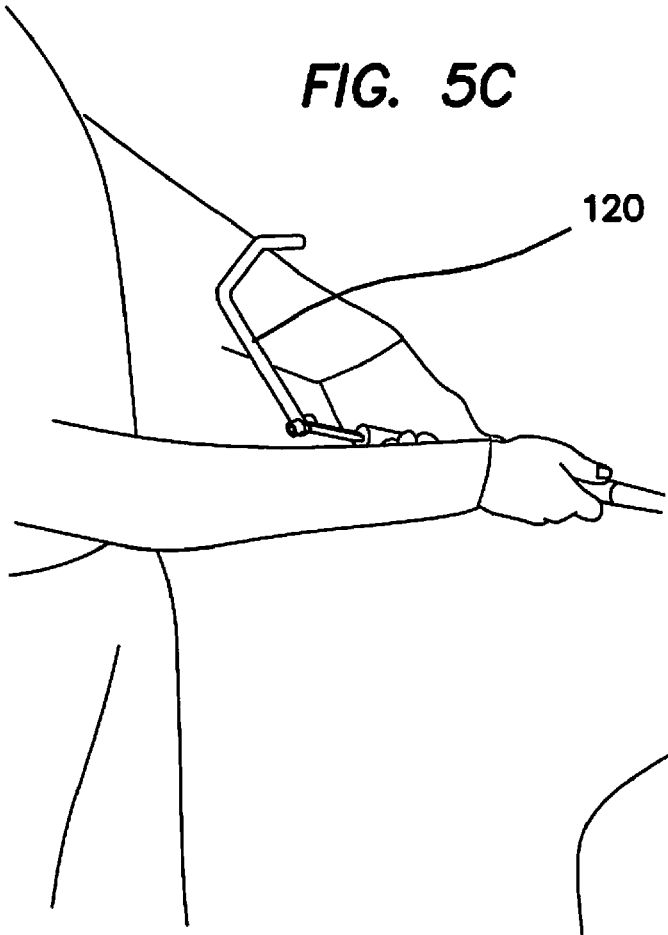
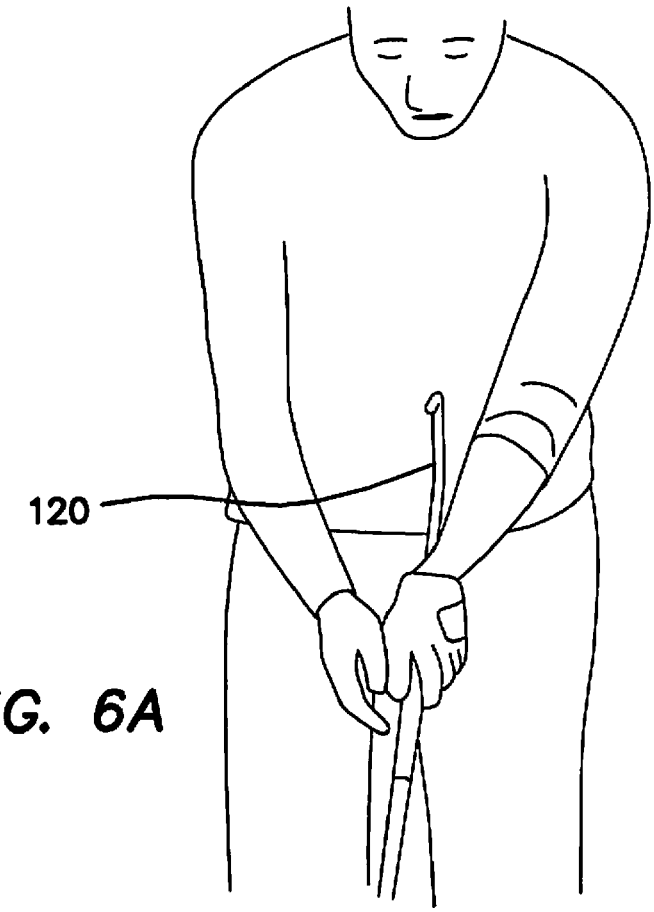
FIG. 6A

TRAINING TOOL FOR MAINTAINING PROPER HAND POSITION THROUGH A GOLF SWING AND METHOD OF USE

FIELD OF THE INVENTION

The embodiments of the present invention relate to a tool for training a golfer to maintain proper hand position though a golf swing.

BACKGROUND

Golf is one of the most popular sporting activities in the world and generates billions of dollars per year in related revenues. Especially popular are training tools designed to improve aspects of a golfer's game. Such tools may target a golfer's swing, putting technique, alignment, etc. Despite the sheer number of such tools, golfer's are always in search of new, better tools.

Thus, there exists an ongoing need for a new and improved tool which targets a golfer's swing. More particularly, a tool which trains a golfer to maintain proper hand position through a golf swing. Advantageously, the tool addresses all swing types including chips, drives and in-between.

SUMMARY

Accordingly, one embodiment of the present invention is an adjustable arching arm which attaches to a top portion of a golf club such that the adjustable arching arm is generally aligned with a club face. The adjustable arching arm is adjustable in a generally vertical plane to accommodate chip shots and full swings.

In a chipping mode, the adjustable arching arm is in a lower position and is intended to maintain contact with an inside of the left forearm (of a right handed golfer) through a chip shot thereby training the golfer to hold his (or her) hands in the correct position through a chip shot. In a full swing mode, the adjustable arching arm is adjusted to an upper position such that the arm is able to move from inside of the left forearm to outside of the left forearm during the swing to indicate good hand position. That is, if the adjustable arching arm remains against an inside of the left forearm during a full swing, the golfer's hands are out of position.

Other variations, embodiments and features of the present invention will become evident from the following detailed description, drawings and claims.

BRIEF DESCRIPTION OF THE DRAWINGS

FIGS. 5*a* through 5*c* illustrate the golf training tool in ideal position during a chip swing at address, back swing and follow through according to the embodiments of the present invention; and FIGS. 6*a* through 6*c* illustrate the golf training tool in a first position and second position, respectively, during a full swing according to the embodiments of the present invention.

DETAILED DESCRIPTION

Figure 1:
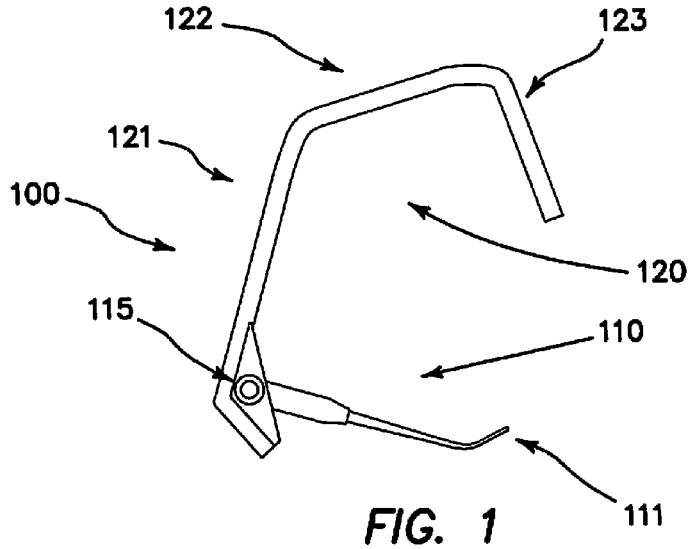
FIG. 1 illustrates a golf training tool according to the embodiments of the present invention.

For the purposes of promoting an understanding of the principles in accordance with the embodiments of the present invention, reference will now be made to the embodiments illustrated in the drawings and specific language will be used to describe the same. It will nevertheless be understood that no limitation of the scope of the invention is thereby intended. Any alterations and further modifications of the inventive feature illustrated herein, and any additional applications of the principles of the invention as illustrated herein, which would normally occur to one skilled in the relevant art and having possession of this disclosure, are to be considered within the scope of the invention claimed.

The embodiments of the present invention relate to a training tool designed to assist golfers with maintaining proper hand position through a golf swing. Improper hand position is a primary reason for poor golf results. For example, golfers can "break their hands" or "have their hands behind the ball" at impact. The training tool described herein may be made of any suitable materials including plastics, alloys, composites and the like.

FIG. 1 shows a training tool 100, which as shown, comprises a base section or member 110 supporting an adjustable arching arm 120. Those skilled in the art will recognize that the tool 100 may be fabricated as a single unit, or using multiple members as shown. The adjustable arching arm 120 is attached to, and extends from, the base member 110 using fastening means 115 allowing the arm 120 to rotate between a first position and a second position and optionally positions in-between. The fastening means 115 may be a screw, rivet, clip or other device capable of rotatably attaching the base section 110 and adjustable arching arm 115.

Figure 2A:
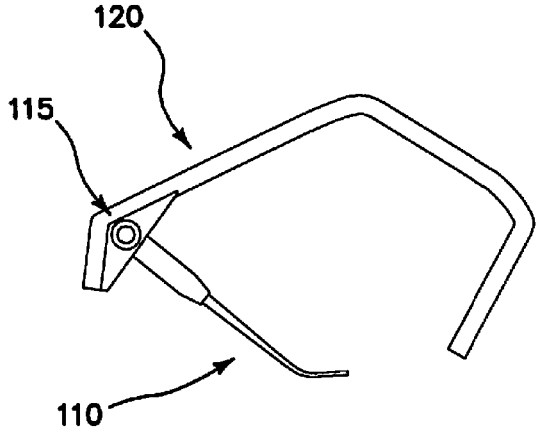
FIGS. 2*a* and 2*b* illustrate a golf training tool moving from a lower to an upper position according to the embodiments of the present invention.
Figure 2B:
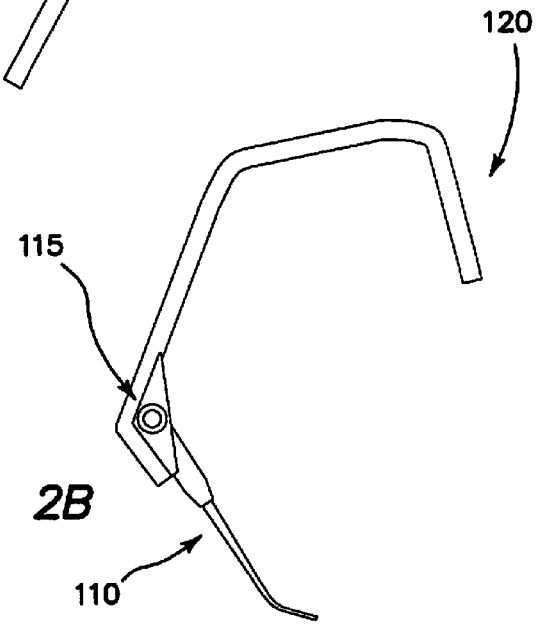

FIGS. 2*a* and 2*b* show the training tool 100 with the adjustable arching arm 120 in various positions between a low position (FIG. 2*a*) and an upper position (FIG. 2*b*). The adjustable arm 120 may also stop at positions therebetween. The adjustable arching arm 120 allows the training tool 100 to be manipulated for different golfers. The fastening means 115 connects the base member 110 and adjustable arching arm 120 in a frictional manner such that the adjustable arching arm 120 may be adjusted by applying a light force in the desired direction such that the adjustable arm 120 rotates about the fastening means 115. In an alternative arrangement, the fastening means 115 allows the adjustable arching arm 120 to stop only in pre-set positions between the first lower position and the second upper position rather than at any desired position therebetween.

As shown, the adjustable arching arm 120 is contoured with generally three sections comprising an upward section 121, outward section 122 and downward section 123. While the adjustable arching arm 120 can be formed of the three distinct sections 121-123, it is obvious that the adjustable arching arm 120 may comprise a more rounded, smooth transition in the form of an arch which does not involve readily identifiable distinct sections.

Figure 3:
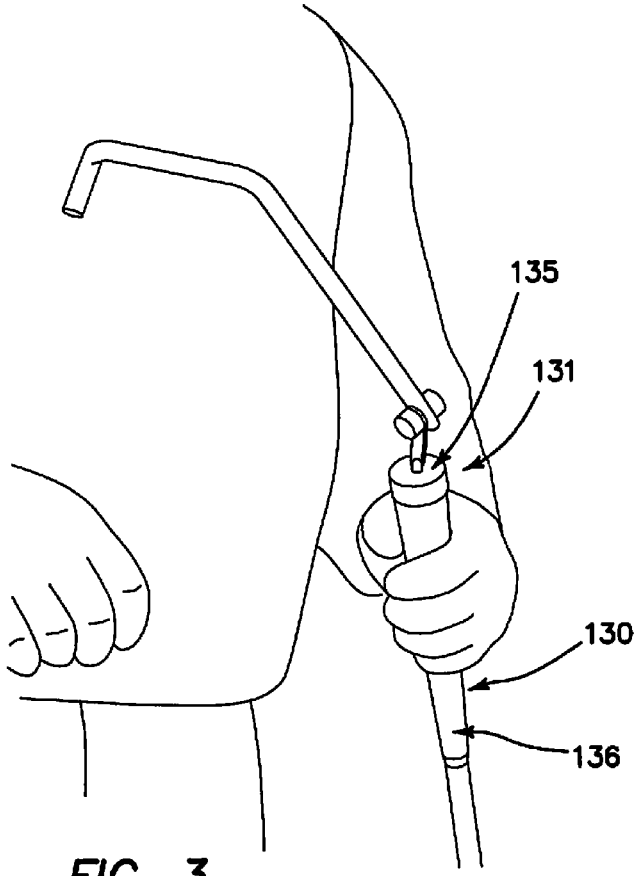
FIG. 3 illustrates the golf training tool in place on a golf club according to the embodiments of the present invention.
Figure 4A:
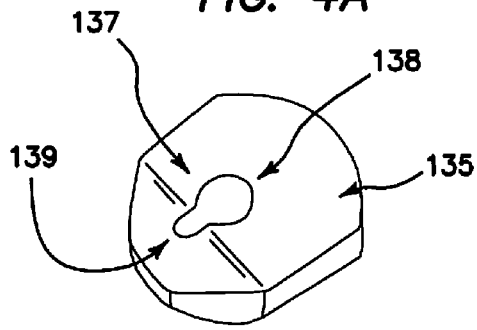
FIGS. 4*a* and 4*b* show a cap and prong, respectively, used to maintain the golf training tool in place on a golf club according to the embodiments of the present invention.
Figure 4B:
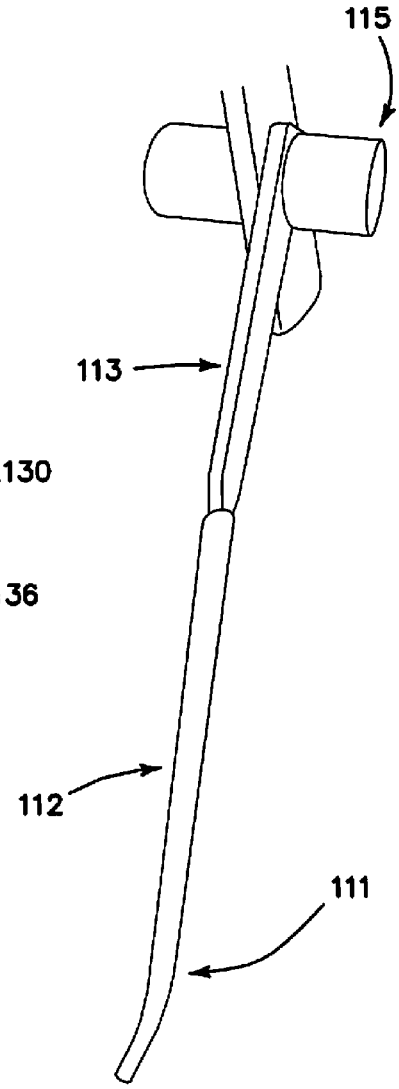

As shown in FIG. 3, use of the training tool 100 involves attaching the training tool 100 to a golf club 130 at the top end of the shaft 131 such that the adjustable arching arm 120 extends into the golfer's arm and hand area. In one embodiment, a curved hook pin or prong 111, shown in FIG. 4*b*, forms a portion of the base member 110 and inserts into a top portion of the golf club shaft 131. FIG. 4*a* shows a cap 135 configured to fit over a top of the golf club shaft 131 and corresponding grip 136. An opening 137 in the cap 135 accommodates the prong 111. The cross-sectional shape of the opening 137 comprises a circular portion 138 and a protruding portion 139 which allows a rounded portion 112 of the prong 111 to insert therethrough followed by a flat portion 113 of the prong 111. The relationship between the opening 137 and the prong 111, and the cap 135 with the shaft grip 136, maintains the training tool 100 in place through a golf swing. Those skilled in the art will recognize that other means and devices may be used to connect the training tool 100 to a golf club.

As described below, the training tool 100 serves dual purposes. First, the training tool 100 trains a golfer to maintain proper hand position through a chip shot. Second, the training tool 100 trains a golfer to maintain proper hand position through a complete golf swing. The training tool 100 accomplishes the dual purposes in distinct ways.

Figure 5A:
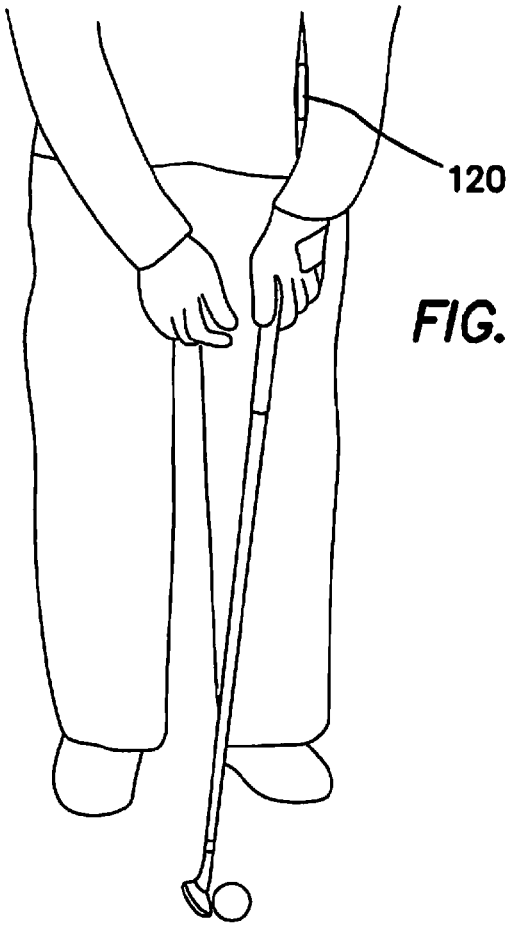
Figure 5B:
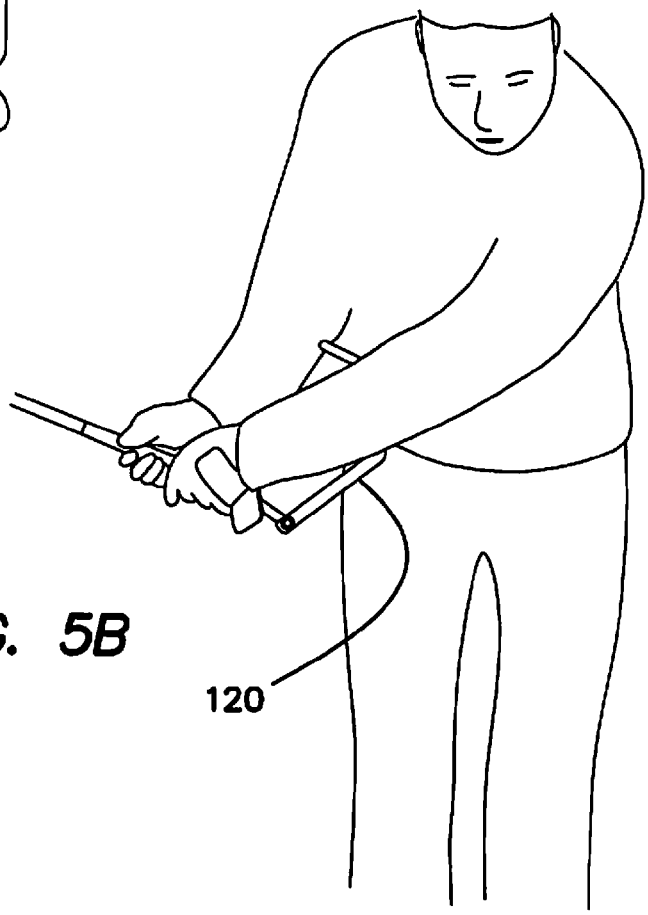

FIGS. 5*a* through 5*c* show the training tool 100 in position during a chip shot. The adjustable arching arm 120 is in a lower position while in the chipping mode. In the chip mode, the adjustable arching arm 120 is intended to rest against the inside or forearm of the golfer's left arm (right arm for a left-handed golfer) through a chipping motion. That is, the adjustable arching arm 120 acts as a guide throughout the chip shot from address to backswing to follow through. If during the chip shot the adjustable arching arm 120 loses contact with the golfer's left arm, the golfer has not maintained his hands in the proper position throughout the chip shot. Therefore, the training tool 100 encourages muscle memory associated with a proper chip shot such that the golfer's hands remain in proper position throughout a chip shot.

Figure 6B:
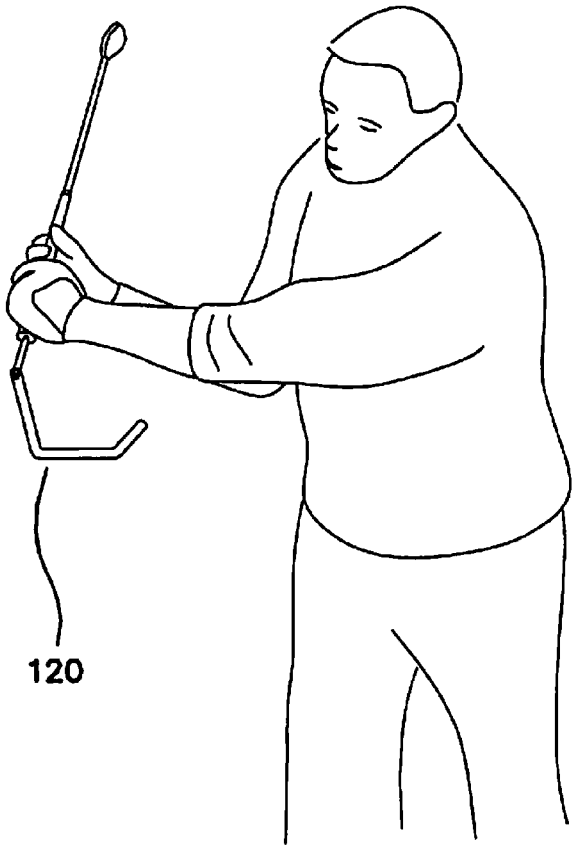
Figure 6C:
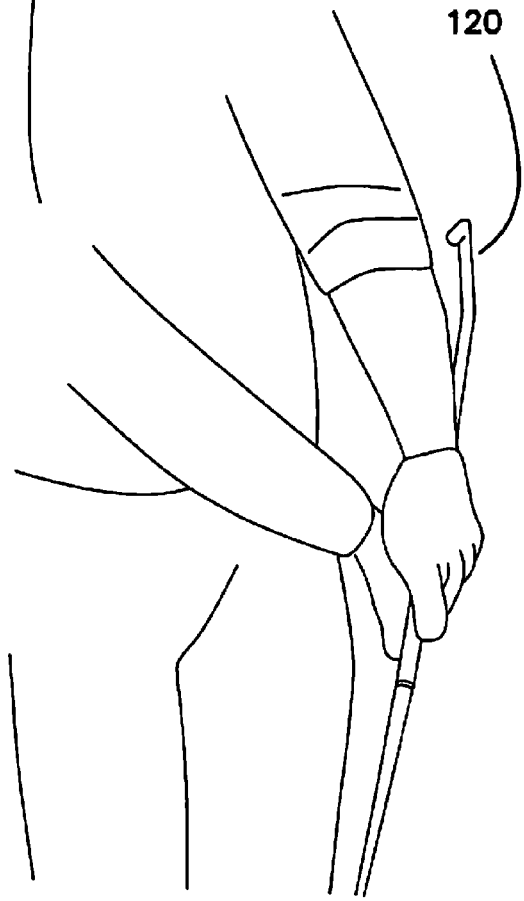

FIGS. 6*a* through 6*c* show an address position, first position (backswing) and second position (follow through) of the training tool 100 during a full swing with the golfer's hand in the proper position throughout. The adjustable arching arm 120 is in an upper position while in the full swing mode. At address, as shown in FIG. 6*a*, and during an initial portion of the front swing, like in the chipping mode, the adjustable arching arm 120 rests against the inside or forearm of the golfer's left arm (right arm for a left-handed golfer). During the backswing, the adjustable arm 120 moves away from the arms of the player. Then, during the front swing of a proper full swing, the adjustable arching arm 120 moves under the left arm of the golfer and moves forward of the left arm during the follow through of the full swing. During a full swing with the hands maintaining a proper position, the adjustable arching arm 120 moves forward of the left arm such that at the conclusion of the back swing and beginning of the front swing the adjustable arching arm 120 shifts from a first position against the inside of the left arm to a second position forward of the left arm.

Although the invention has been described in detail with reference to several embodiments, additional, variations and modifications exist within the scope and spirit of the invention as described and defined in the following claims.

I claim:

1. A golf swing training tool comprising:

a base section attachable to a top portion of a golf club; and an adjustable arching arm extending from said base section, said arm adjustable in a generally vertical plane about said base section and configured to extend from a top portion of a golf club into a position near arms of a player, said adjustable arching arm including a curved upper portion extending substantially away from a player when said base section is attached to a top portion of a golf club.

2. The golf swing training tool of claim 1 further comprising a cap configured to fit over a top portion of a golf club, said cap including an opening for receipt of at least a portion of the base section.

3. The golf swing training tool of claim 1 wherein said base section includes a curved prong for insertion into a top portion of a golf club.

4. The golf swing training tool of claim 1 wherein said adjustable arching arm may be adjusted to a lower position for chip shots and an upper position for full golf swings.

5. The golf swing training tool of claim 4 wherein said adjustable arching arm in a lower position acts as a guide by resting against an inside of a lead arm of a golfer throughout a chip shot.

6. The golf swing training tool of claim 4 wherein said adjustable arching arm in an upper position acts as a guide by resting against an inside of a lead arm of a golfer during a back swing and initial portion of a front swing and said adjustable arching arm being forward of a lead arm of a golfer during at least a final portion of said front swing.

7. A golf swing training tool comprising:

a base member having a curved prong for insertion into a top portion of a golf club;

a cap configured to fit over the top portion of the golf club, said cap configured to receive the curved prong;

an adjustable arching arm extending from said base member towards a golfer holding the golf club such that the adjustable arching arm is in a position near arms of a golfer holding the golf club, said adjustable arching arm adjustable in a generally vertical plane, said adjustable arching arm including a curved upper portion extending substantially away from a player when said base section is attached to a top portion of a golf club.

8. The golf swing training tool of claim 7 wherein said adjustable arching arm may be adjusted to a lower position for chip shots and an upper position for full golf swings.

9. The golf swing training tool of claim 8 wherein said adjustable arching arm in a lower position acts as a guide by resting against an inside of a lead arm of a golfer throughout a chip shot.

10. The golf swing training tool of claim 8 wherein said adjustable arching arm in an upper position acts as a guide by resting against an inside of a lead arm of a golfer during a back swing and initial portion of a front swing and said adjustable arching arm being forward of a lead arm of a golfer during at least a final portion of said front swing.

11. A method of using a golf training tool having an adjustable arching arm extending from a base section, comprising:

positioning a cap having an opening on a top portion of a golf club;

inserting at least a portion of said base section through said opening in said cap and into said golf club; and positioning said adjustable arching arm such that said adjustable arching arm rests against an inside of a lead arm when in an address position over a golf ball and a curved upper portion of said adjustable arm extends substantially away from a player.

12. The method of claim 11 further comprising adjusting said adjustable arching arm into a lower position for chip shots.

13. The method of claim 11 further comprising adjusting said adjustable arching arm into an upper position for full golf swings.

* * * * *